United States Patent [19]

Getty

[11] 4,087,076

[45] May 2, 1978

[54] PNEUMATIC JACK

[75] Inventor: Stewart W. Getty, Cornelia, Ga.

[73] Assignee: Dorothy A. Getty, Cornelia, Ga.

[21] Appl. No.: 851,876

[22] Filed: Nov. 16, 1977

[51] Int. Cl.[2] ..... B66F 3/30

[52] U.S. Cl. ..... 254/93 R; 92/165 R

[58] Field of Search ..... 254/93 R, 93 H, 93 HP, 254/2 R, 2 B, 2 C; 92/165 R, 165 PR

[56] References Cited

U.S. PATENT DOCUMENTS

| | | | |
|---|---|---|---|
| 39,458 | 8/1863 | Baird | 92/165 R |
| 1,447,242 | 3/1923 | Fritz | 254/93 H |
| 2,269,835 | 1/1942 | Wallace et al. | 254/93 R |

FOREIGN PATENT DOCUMENTS

| | | | |
|---|---|---|---|
| 2,310,350 | 7/1974 | Germany | 254/93 H |

*Primary Examiner*—Robert C. Watson
*Attorney, Agent, or Firm*—Shlesinger, Arkwright, Garvey & Dinsmore

[57] ABSTRACT

A pneumatic jack comprising a cylinder having a removable cover, an inlet for pressurized gas near the bottom of the cylinder, a piston having a resilient piston cup within the cylinder and positioned for vertical movement therein, the cover including a centrally positioned piston rod bushing and at least two laterally offset stabilizer rod bushings, the bushings extending above and below the cover, a piston rod secured to the piston and extending through the piston rod bushing, and at least two stabilizer rods also secured to the piston and extending through the stabilizer rod bushings, and helical springs surrounding each of the stabilizer rods and engaging the piston and the cover for urging the piston downwardly within the cylinder.

20 Claims, 4 Drawing Figures

PNEUMATIC JACK

This invention relates to a pneumatic jack of the heavy duty type. More particularly, this invention relates to a pneumatic jack for heavy duty, industrial use, particularly for trucks, aircraft, and the like.

BACKGROUND AND OBJECTS

A number of different types of jacks are available for industrial use, both of the hydraulic and pneumatic type. Generally speaking, the hydraulic jacks are more expensive than the pneumatic jacks, for a number of reasons. However pneumatic jacks are particularly desirable since most shops have readily available pressurized air, and even mobile servicing units usually have pressurized air available.

But regardless of the type of jack, for industrial applications in servicing trucks, aircraft and the like, a number of strict requirements are imposed upon the jacks by necessity. Primary among the requirements are the size requirements for the jack. Quite frequently, when a truck is being serviced, for example, the jack must be positioned between two tandom wheels in order to engage the walking beam or frame structure of the truck. The same is also true for aircraft, in both of which applications the wheels are frequently spaced quite close together. Additionally, it is quite frequent that ground clearance is minimal, thus further restricting the height of the jack.

Both the width and height limitations impress further difficulties upon pneumatic jacks in particular. With hydraulic jacks, it is relatively simple to increase the pressure of the hydraulic fluid. But for pneumatic jacks, the available air pressure in shops and the like is usually restricted, and thus the jack must be capable of operating typically at a pressure of 100–200 psi air pressure.

The first suggestion to overcome the restrictions on air pressure would of course be to increase the size of the piston in the jack, but this would of course necessitate an enlarged cylinder or housing, and as indicated above, height and width restrictions are barriers to increased piston size. As a further result, the amount of piston travel is of course limited by the height of the cylinder, and thus the amount of lift available is restricted.

In order to increase the available piston surface area, it is known to utilize an oval piston and cylinder arrangement which enables a greater psiton area while still maintaining the width and height requirements of the jack.

However a frequent and severe problem among jacks of an oval configuration is that when the jack is in its elevated position, it is quite easy for the piston to become cocked in the cylinder. When this occurs, frequently the cylinder wall is scored and the piston may become damaged as well. This requires disassembly of the jack and repair. Additionally, the damage to the jack and the down time can be expensive.

In the past, only the contact between the piston rod and the gland prevented cocking of the piston, but due to the construction of air jacks, this was frequently inadequate, and cocking of the piston did result.

The present invention provides an effective yet simple means to reduce or eliminate problems encountered when a piston becomes cocked within the cylinder. This is accomplished by providing at least two guide rods or stabilizer rods which are attached to the piston and extend through the cover of the jack. These stabilizer rods provide two to three times the surface area of contact over prior art jacks to prevent the pistons from cocking.

Accordingly, it is a primary object of this invention to provide an improved pneumatic jack which overcomes disadvantages of prior art jacks.

Still another object of this invention is to provide a pneumatic jack having a low, narrow profile and high capacity.

Yet another object of this invention is to provide a pneumatic jack which prevents cocking of the piston in the cylinder.

Still a further object of this invention is to provide a pneumatic jack of durable construction which may be easily serviced.

Yet a further object of this invention is to provide a pneumatic jack having an automatic safety device to prevent the jack from dropping.

A still further object of this invention is to provide a pneumatic jack having stabilizer rods for preventing cocking of the piston in the cylinder.

DESCRIPTION OF THE DRAWINGS

These and other objects and advantages of this invention will become apparent when considered in light of the following description and claims when taken together with the accompanying drawings in which:

DESCRIPTION OF THE INVENTION

Figure 1:
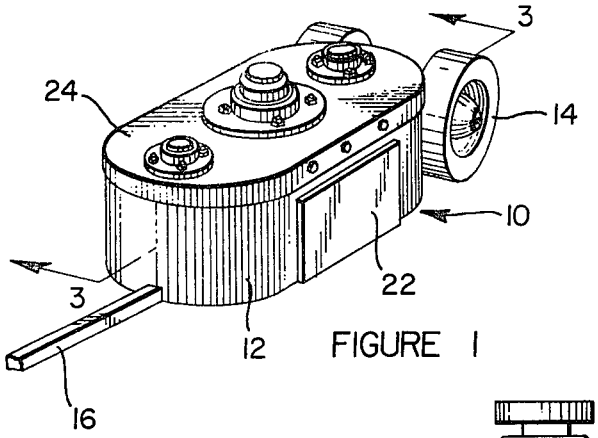
FIG. 1 is a perspective view of the jack of this invention.
Figure 4:
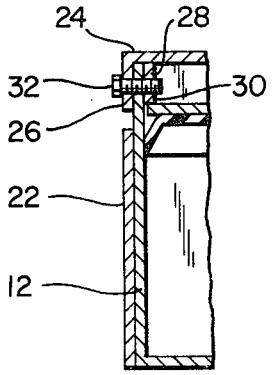
FIG. 4 is a fragmentary cross-sectional view along lines 4—4 of FIG. 2 and viewed in the direction of the arrows.

Referring now to the drawings, and particularly to FIG. 1, the jack of this invention, generally designated 10 is seen to include a cylinder or housing 12 having wheels 14 secured thereto at one end. Throughout the specification, the word "cylinder" is used in its broad sense and is intended to refer to the housing within which a piston travels. The term is not intended to be restricted to a geometrical cylinder.

At the end of cylinder 12 opposite to the wheels 14, is provided a handle 16 to facilitate moving the jack into its positions for use. The wheels are positioned such that they do not contact the ground until the handle is lifted slightly, in order that the base of the cylinder 12 may fully contact the ground when in use. Of course it is possible that the bottom of the wheels 14 may be even with the bottom of the cylinder 12, as long as the wheels are not lowered to the point where they would interfere with proper contact of the cylinder on the ground.

Figure 2:
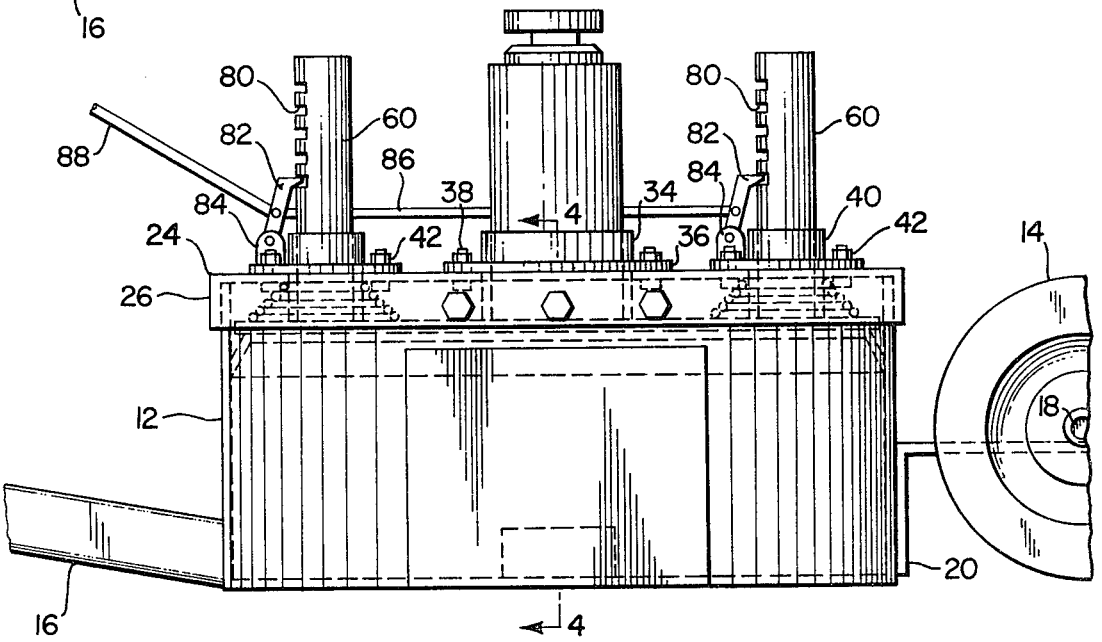
FIG. 2 is a side elevation view of the jack of this invention.
Figure 3:
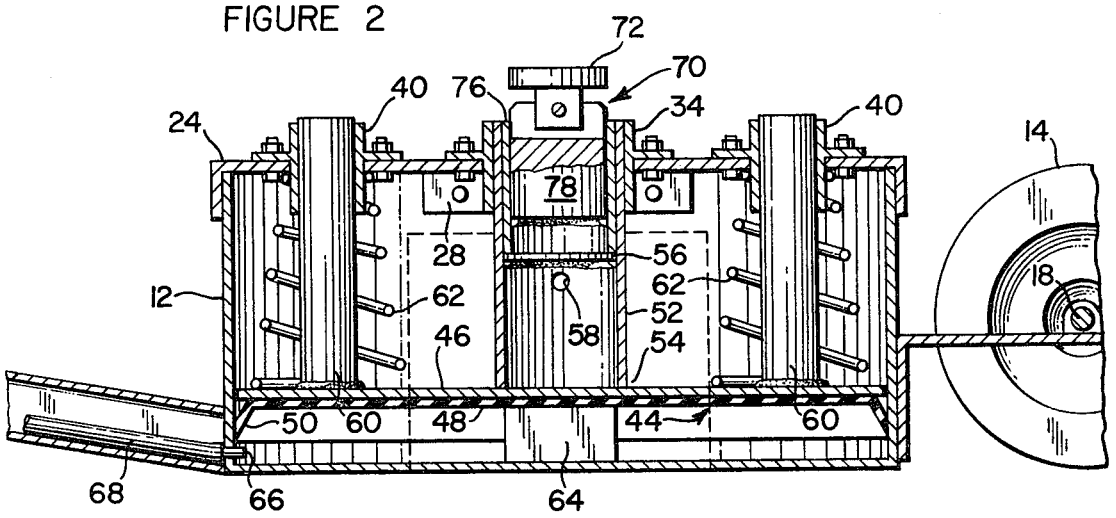
FIG. 3 is a cross-section along lines 3—3 of FIG. 1 and viewed in the direction of the arrows.

Referring to FIGS. 2 and 3, it is seen that the wheels 14 are mounted on an axle 18 journaled in a suitable bracket 20 attached to the cylinder housing 12. In the preferred embodiment, the cylinder 12 has an oval configuration as best seen in FIG. 1. When this configuration is used, it is preferable to reinforce the straight side walls by means of a plate 22 attached thereto as by welding. In an oval jack of this type, the straight side walls would generally be the weakest points, and thus the plate strengthens these walls.

The cylinder 12 is provided with a cover member 24 having a turned down flange 26 which goes over the walls of the cylinder 12. The walls of the cylinder are provided at the uppermost portion along the sides with a plate 28 welded thereto and provided with suitable, threaded apertures 30. In this manner, the cover 24 may be secured to the cylinder 12 by means of bolts 32. It is not necessary that the joint between the cover 24 and the cylinder 12 be an air tight joint, and this of course materially facilitates assembly and disassembly of the apparatus while reducing the cost thereof.

The cover is provided with a centrally disposed bushing 34 having an annular flange 36 extending radially outwardly therefrom. The bushing passes through an aperture in the cover 24 and is bolted to the cover by means of bolts 38. The bushing extends below the cover into the cylinder to a point slightly above the upper limit of travel of the piston, or alternatively may serve as a stop for the upper limit of travel of the piston. Additionally, the bushing extends above the cover as much as possible taking into consideration the minimum ground clearance or height available.

Also attached to the cover 24 are two additional flange bushings 40 of substantially the same shape as bushing 34, although having a slightly smaller size. Bushings 40 are secured to the cover by means of bolts 42.

Referring to FIG. 3, there is seen to be a piston generally designated 44 which comprises a rigid piston plate 46 and a resilient piston cup 48. The piston plate 46 is preferably made of steel, while the piston cup 48 is made of rubber or suitable synthetic material and is adhesively bonded to the bottom surface of the plate 46. The piston cup 48 includes a depending skirt portion 50 which contacts the inner walls of the cylinder 12 to seal the air chamber therebeneath. A piston rod 52 extends through the bushing 34 and is welded to the piston plate 46 at 54 as shown. The piston rod 52 is preferably tubular and has a seat 56 welded to the interior thereof. In one embodiment, the piston rod 52 is provided with a pair of diametrically opposed apertures 58 for receiving a safety pin when the jack is in the elevated position.

Also welded to the piston plate 46 are two stabilizer rods 60 positioned so as to extend upwardly through the bushings 40. The stabilizer rods 60 ar preferably of solid bar stock and are welded to the piston plate 46. In the embodiment shown in the drawings wherein the cylinder housing 12 is of oval configuration, the piston rod 52 and the stabilizer rods 60 each lie on the major axis of the oval cylinder. Additionally, it is preferred that the stabilizer rod be positioned at least halfway from the piston rod to the end walls, and may be positioned slightly more than halfway.

Around the piston rods 60 are provided coil springs 62 which bear against the piston plate 46 and the inside of cover 24. The springs 62 are preferably of a conical configuration which enables the coils to actively nest together so as to not limit the vertical extent of travel of the piston as would be the case if cylindrical coil springs are used.

In one embodiment, the bushing 34 extends downwardly into the cylinder a distance equal to the width of the plate 28. In this case, the plate 28 serves as a stop for the upward travel of the piston, and also further assists in preventing cocking of the piston when in its topmost position. Since the piston plate 46 will bear against the lower edge of plates 28 along their entire length.

The bottom of the cylinder 12 is provided with a block 64 which is welded to the bottom thereof, this block serving as a stop limiting the downward travel of the piston to prevent damage to the piston skirt 50. Additionally, an air inlet nozzle 66 is provided, and has a suitable hose 68 attached thereto. In the preferred embodiment, the hose 68 extends inside of the handle 16 to a point at which an air supply line may be attached. Of course the nozzle 66 must be positioned below the lower most limit of travel of skirt 50 to prevent damage to the skirt.

The hollow piston rod 52 is constructed so as to receive an adaptor member 70 which is telescopically received in the piston rod 52. The adaptor member 70 is also tubular and rests on the seat member 56. The adaptor is provided with a head 72 pivotally attached thereto as at 74 the adaptor consists of a tubular member 76 having a solid member 78 welded therein. Alternatively, similarly constructed extension members (not shown) may be inserted into the piston rod 52 and the rocker head adaptor 70 may then be inserted into the extension members. By this construction, although the jack has a low profile and a comparatively short limit of travel, the jack may be used to lift trucks or the like at points having a higher ground clearance.

The rocker head adaptor 70 also assists in preventing cocking of the piston 44 within the cylinder 24, since some small degree of movement may be taken up in the adaptor 70.

A safety feature of this invention is illustrated in FIG. 2 wherein the piston is shown in its uppermost position (in phantom lines) and the stabilizer rods 60 are seen to be provided with a plurality of notches 80 cut therein. A detent member 82 is pivotally attached to the flange 42 by means of a suitable boss 84. The detent members 82 are biased by means of a spring (not shown) into engagement with the notches 80 in the stabilizer rods 60. Additionally, the two detents 82 are connected by means of a linkage rod 86 for simultaneous actuation. An actuator rod 88 extends upwardly towards the distal end of the handle 16 for convenient use by the operator. The detents 82 are provided with cam surfaces which enable upward travel of the jack, but prevent downward travel of the jack until the actuator rod 88 pulls the detents out of engagement with the notches against the spring bias. It has been found that this type of safety mechanism is preferable to the use of a pin in holes 58 since frequently the user of the jack would not use such a pin due to the inconvenience thereof, but would indeed use the automatic type of safety device illustrated in FIG. 2 because of its convenience.

A similar linkage system could be used wherein a detent member would engage the piston rod 52, and may be preferable in some applications. Alternatively a detent member and corresponding linkage could be used to engage each of the stabilizer rods 60 as well as the piston rod 52.

Although the invention thus far described has been with reference to an oval jack, the principal of the invention indeed applies to a circular jack as well. For a circular jack, the construction would be substantially the same however with a circular piston, it would be preferable to use three stabilizer rods radially spaced at approximately 120° intervals. This construction would provide maxium stability for a circular piston.

While this invention has been described as having a preferred design, it will be understood that it is capable of further modification. This aplication, is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What I claim is:

1. A pneumatic jack comprising:

a cylinder having a removable cover, an inlet for pressurized gas near the bottom of said cylinder, a piston plate within said cylinder and position for vertical movement therein, a resilient piston cup connected to said piston plate and having a skirt portion in sealing engagement with the inside wall of said cylinder, said cover including a central piston rod bushing and at least two laterally offset stabilizer rod bushings, said bushings extending above said cover and below said cover into said cylinder, a piston rod secured to said piston plate and extending through said piston rod bushing, at least two stabilizer rods secured to said piston plate and extending through said stabilizer rod bushings, said stabilizer rods and said piston rod being perpendicular to said piston plate, and spring means surrounding each of said stabilizer rods for urging said piston plate downwardly in said cylinder.

2. A pneumatic jack as in claim 1 wherein:

said cylinder has a substantially oval cross section and said piston plate has a complimentary oval shape.

3. A pneumatic jack as in claim 2 and wherein:

said jack includes two of said stabilizer rods.

4. A pneumatic jack as in claim 3 and wherein:

said stabilizer rods are positioned along the major axis of said oval piston plate.

5. A pneumatic jack as in claim 4 and wherein:

said stabilizer rods are positioned at least one-half of the distance from said piston rod to the end of said piston plate.

6. A pneumatic jack as in claim 3 and wherein:

said spring means comprises a conical coil spring bearing against said piston plate and said cover.

7. A pneumatic jack as in claim 1 and wherein:

said cylinder is substantially circular in cross-section and said piston plate has a complimentary circular shape.

8. A pneumatic jack as in claim 7 wherein:

said jack includes three of said stabilizer rods.

9. A pneumatic jack as in claim 8 and wherein:

said stabilizer rods are radially spaced at intervals of about 120°.

10. A pneumatic jack as in claim 4 and wherein:

said cover is secured to said cylinder by means of bolts.

11. A pneumatic jack as in claim 4 and wherein:

said bushings include a sleeve having a radial flange thereon.

12. A pneumatic jack as in claim 11 and wherein:

said radial flange is bolted to said cover.

13. A pneumatic jack as in claim 1 and wherein:

said cover includes releasably safety latch means engageable with at least one of said stabilizer rods.

14. A pneumatic jack as in claim 13 and wherein:

said latch means is engageable with each of said stabilizer rods.

15. A pneumatic jack as in claim 14 and wherein:

said stabilizer rods includes plurality of vertically spaced notches formed therein and said latch means includes detent means engageable with said notches.

16. A pneumatic jack as in claim 15 wherein:

said detent means include detent members pivotally mounted on said cover adjacent each of said stabilizer rods, said detent members being resiliently biased into engagement with said notches.

17. A pneumatic jack as in claim 16 and including:

linkage means for remote simultaneous disengagement of each of said detent member from said notches.

18. A pneumatic jack as in claim 5 and including:

a first stop member for limiting upward travel of said piston plate, a second stop member for limiting downward travel of said piston plate.

19. A pneumatic jack as in claim 4 and wherein:

said piston rod has a hollow tubular configuration open at its upper end and is provided with seat means internally thereof and spaced from the upper end.

20. A pneumatic jack as in claim 19 and including:

a rocker head adaptor within said piston rod and bearing against said seat means.

* * * * *